US008291615B2

(12) United States Patent
Kita et al.

(10) Patent No.: US 8,291,615 B2
(45) Date of Patent: Oct. 23, 2012

(54) INNER SOLE STRUCTURE FOR A SPORTS SHOE

(75) Inventors: Kenjiro Kita, Ikoma-gun (JP); Kazuhiko Suzuki, Wakayama (JP)

(73) Assignee: Mizuno Corporation, Osaka-shi (JP)

( * ) Notice: Subject to any disclaimer, the term of this patent is extended or adjusted under 35 U.S.C. 154(b) by 500 days.

(21) Appl. No.: 12/322,786

(22) Filed: Feb. 5, 2009

(65) Prior Publication Data

US 2009/0241373 A1 Oct. 1, 2009

(30) Foreign Application Priority Data

Mar. 28, 2008 (JP) ..... 2008-86167

(51) Int. Cl.
*A43B 13/28* (2006.01)
*A43B 13/18* (2006.01)
*A43B 13/38* (2006.01)

(52) U.S. Cl. ..... 36/27; 36/28; 36/44

(58) Field of Classification Search ..... 36/105, 36/107, 30 R, 103, 27, 28, 35 R, 37, 43, 44, 36/71, 158, 168
See application file for complete search history.

(56) References Cited

U.S. PATENT DOCUMENTS

| | | | | | |
|---|---|---|---|---|---|
| 897,874 | A * | 9/1908 | Byrne | 36/37 |
| 1,693,911 | A * | 12/1928 | Schmeer | 36/85 |
| 1,708,683 | A * | 4/1929 | Roberts | 36/37 |
| 2,319,550 | A * | 5/1943 | Lewy | 36/160 |
| 2,677,906 | A * | 5/1954 | Reed | 36/153 |
| 3,861,399 | A * | 1/1975 | Huff | 36/181 |
| 4,774,774 | A * | 10/1988 | Allen, Jr. | 36/28 |
| 5,337,492 | A * | 8/1994 | Anderie et al. | 36/28 |
| 5,799,415 | A * | 9/1998 | Kenji et al. | 36/44 |
| 6,205,681 | B1 * | 3/2001 | Kita | 36/28 |
| 6,515,539 | B1 * | 2/2003 | Levanon et al. | 330/4 |
| 6,647,645 | B2 * | 11/2003 | Kita | 36/28 |
| 7,162,815 | B2 * | 1/2007 | Miyauchi et al. | 36/103 |
| 7,484,317 | B2 | 2/2009 | Kita et al. | |
| 7,624,515 | B2 | 12/2009 | Kita et al. | |
| 7,707,743 | B2 * | 5/2010 | Schindler et al. | 36/28 |
| 2006/0234012 | A1 * | 10/2006 | Wang | 428/188 |

FOREIGN PATENT DOCUMENTS

| | | |
|---|---|---|
| JP | 2003-339405 | 12/2003 |
| JP | 2004-313774 | 11/2004 |
| JP | 2005-253578 | 9/2005 |
| JP | 4020953 | 12/2007 |

* cited by examiner

*Primary Examiner* — Khoa Huynh
*Assistant Examiner* — Melissa Lalli
(74) *Attorney, Agent, or Firm* — W. F. Fasse

(57) ABSTRACT

An inner sole structure for a sports shoe includes an upper sheet, a lower sheet below the upper sheet, and a wavy corrugated sheet interposed between the upper and lower sheets. The wavy corrugated sheet has at least two downwardly convex protrusions that form voids between the wavy corrugated sheet and the lower sheet, and that are in sliding contact with an upper surface of the lower sheet. The downwardly convex protrusions of the wavy corrugated sheet slide longitudinally along the lower sheet member when they are subjected to compressive deformation.

29 Claims, 7 Drawing Sheets

INNER SOLE STRUCTURE FOR A SPORTS SHOE

BACKGROUND OF THE INVENTION

The present invention relates generally to an inner sole structure for a sports shoe, and more particularly, to an improvement in the structure for enhancing a cushioning ability, stability and durability, and reducing weight.

Various efforts have been made to enhance cushioning ability of a sock liner in order to improve cushioning properties of an entire sole structure of sports shoes. The most effective way to enhance cushioning ability of the sock liner is form the sock liner of a soft material. However, in this case, when a shoe strikes onto the ground a portion of the sock liner sinks excessively, which may decrease stability at the time of striking onto the ground. Also, by using a soft material the sock liner may easily lose its elasticity and durability may decrease.

A sock liner or an inner sole structure for a shoe as shown in Japanese patent application laying-open publication No. 2004-313774 has been proposed to secure cushioning ability, prevent an excessive sinking of the sock liner, and improve durability. The sock liner structure is composed of an upper liner formed of a soft elastic member, a lower liner disposed under the upper liner and formed of a soft elastic member, and a wavy sheet interposed between the upper liner and the lower liner and having wavy corrugations.

When the shoe strikes onto the ground the upper and lower liners of soft elastic members absorb an impact load to secure cushioning properties, and the wavy sheet interposed between the upper and lower liners restrains deformation of the upper and lower liners to prevent the upper and lower liners from sinking excessively. Also, in this case, since the disposition of the wavy sheet restrains the amount of deformation of the upper and lower liners thus decreasing loss of elasticity of the upper and lower liners to improve durability.

However, in this case, because the upper and lower liners formed of soft elastic members are disposed at the upper and lower positions of the wavy sheet, the entire sock liner structure becomes heavy.

An object of the present invention is to provide an inner sole structure for a sports shoe that can enhance cushioning ability, stability and durability, and that can reduce weight of the structure.

Other objects and advantages of the present invention will be obvious and appear hereinafter.

SUMMARY OF THE INVENTION

An inner sole structure for a sports shoe according to the present invention includes an upper sheet member disposed on an upper side of at least a heel region of the inner sole structure, a lower sheet member disposed below the upper sheet member, and a wavy corrugated sheet member that is interposed between the upper sheet member and the lower sheet member, that has at least two downwardly protruding protrusions disposed longitudinally and adapted to form voids with the upper and lower sheet members, and that is in contact with an upper surface of the lower sheet member such that each of downwardly convex portions of the protrusions slides longitudinally on the lower sheet member at the time of compressive deformation of the protrusions.

According to the present invention, when a compressive load acts onto the upper and lower sheet members at the time of a shoe strike onto the ground, the protrusions of the wavy corrugated sheet receive an upward load from the lower sheet member to deform compressively. At this juncture, each of the voids formed between the wavy corrugated sheet and the upper and lower sheet members deforms into a flattened shape in an upward and downward direction and each of the downwardly convex portions of the two protrusions slides on the lower sheet member in the longitudinal direction. That is, two contact points between the two protrusions and the lower sheet member become offset or shifted to slide longitudinally in the direction away from each other. Thereby, a smooth compressive deformation of each of the protrusions of the wavy corrugated sheet is achieved thus allowing for a moderate sinking of the upper sheet member to enhance cushioning ability. Also, disposition of the wavy corrugated sheet between the upper and lower sheet members prevents an excessive sinking of the upper and lower sheet members, improves stability at the time of striking onto the ground, and restrains deformation of the upper and lower sheet members to improve durability. Moreover, by forming a void between the wavy corrugated sheet and the upper and lower sheet members, the entire weight is decreased.

The wavy corrugated sheet member may have an upwardly convex portion formed between the downwardly convex portions of the downwardly protruding protrusions. The upwardly convex portion may form a first void with the lower sheet member.

In this case as well, at the time of compressive deformation of each of the protrusions of the wavy corrugated sheet, the first void deforms into a flattened shape in an upward and downward direction and each of the downwardly convex portions of the two protrusions slides on the lower sheet member longitudinally in the direction away from each other. Thereby, a smooth compressive deformation of each of the protrusions of the wavy corrugated sheet is achieved thus allowing for a moderate sinking of the upper sheet member to enhance cushioning ability.

A protrusion of the wavy corrugated sheet member located backward may be disposed at a rear end of the heel region. An upraised portion of the backwardly located protrusion may form a second void with the lower sheet member.

In this case, when the rear end of the heel region comes into contact with the ground at the time of a shoe strike onto the ground, compressive deformation of the lower sheet member is not hindered by the upraised portion of the backwardly located protrusion and the lower sheet member can deform compressively in a smooth manner toward the second void. Thereby, cushioning ability at the time of a heel strike onto the ground can be improved. Also, formation of the second void can further reduce the weight.

Another protrusion of the wavy corrugated sheet member may be located forward. An upraised portion of a front side of the forwardly located protrusion may be disposed at a midfoot region. The upraised portion of the forwardly located protrusion may form a third void with the lower sheet member.

In this case, especially at the time of a foot flat contact (or sole entire surface contact) with the ground, cushioning ability of the midfoot portion can be improved. Also, formation of the third void can further reduce the weight.

A front end of the upraised portion of the front side of the forwardly located protrusion may be connected to the upper sheet member directly or through an elastic member.

In this case, since the front end of the upraised portion supports the upper sheet member directly or indirectly from below at the midfoot region a sinking of an arch at the time of a sole contact with the ground can be prevented.

The wavy corrugated sheet member may have an upwardly convex portion formed between the downwardly convex portions of the downwardly protruding protrusions. The upwardly convex portion may be connected to the upper sheet member directly or through an elastic member.

In this case, since the upper sheet member is supported from below by the upwardly convex portion of the wavy corrugated sheet an excessive sinking of the upper sheet member can be prevented and cushioning ability of the heel region can be adjusted.

A protrusion of the wavy corrugated sheet member located backward may be disposed at a rear end of the heel region. An upraised portion of the backwardly located protrusion may be connected to the upper sheet member directly or through an elastic member.

In this case, since the upper sheet member is supported from below by the upraised portion of the backwardly located protrusion of the wavy corrugated sheet at the time of a heel strike onto the ground an excessive sinking of the upper sheet member can be prevented and cushioning ability of the heel rear end portion can be adjusted.

The wavy corrugated sheet member may have a flat, generally W-shaped configuration.

The lower sheet member may constitute an insole of the shoe.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
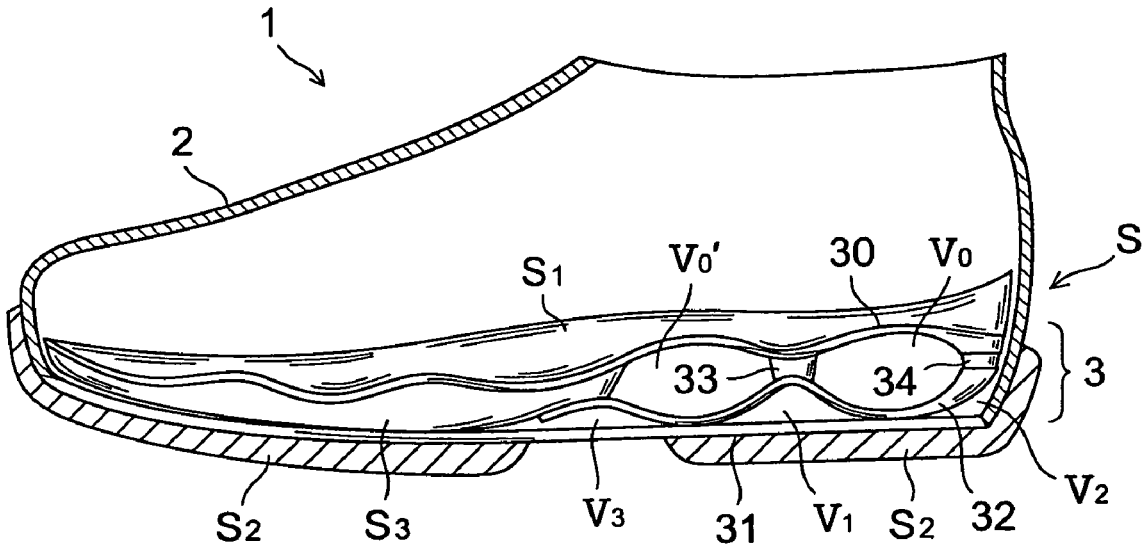
FIG. 1 is a side sectional view of a sports shoe incorporating an inner sole structure according to an embodiment of the present invention.

Referring now to the drawings, as shown in FIG. 1, a sports shoe 1 includes an upper 2 that covers a shoe wearer's foot, and a sole S disposed under the upper 2. The sole S is composed of a midsole $S_1$ that is disposed on a sole side of the shoe wearer's foot, that extends along the entire length of the shoe 1, and that is formed of a soft elastic material, an outsole $S_2$ that is disposed on a bottom side of the shoe 1 and that contacts the ground, and an inner sole structure 3 interposed between the midsole $S_1$ and the outsole $S_2$.

Figure 2:
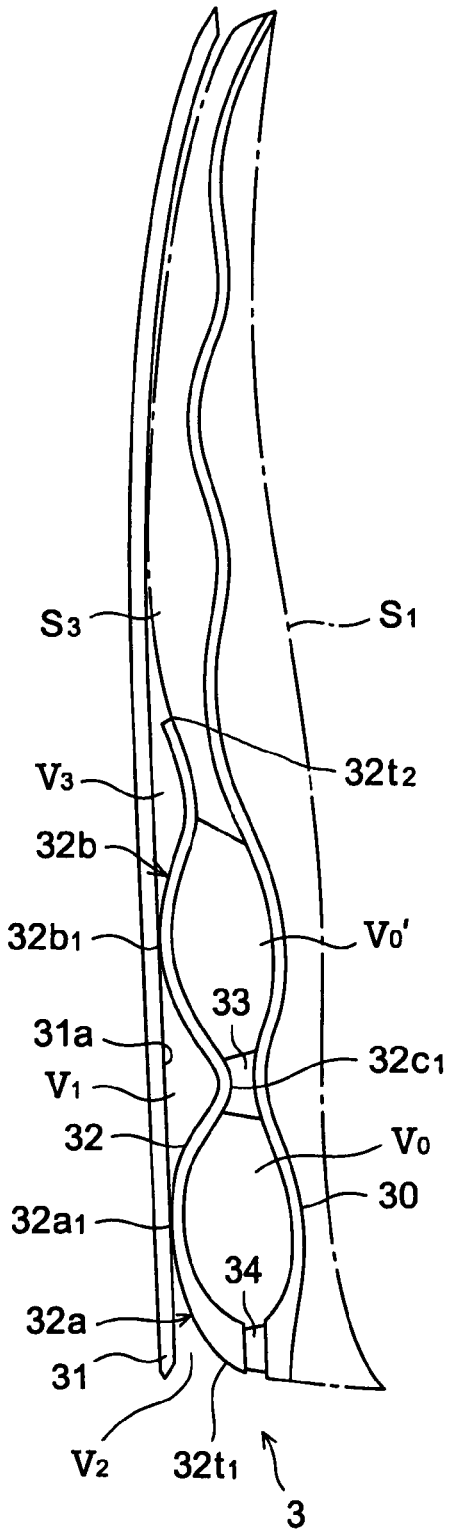
FIG. 2 is an enlarged side view of the inner sole structure of FIG. 1.

As shown in FIG. 2, the inner sole structure 3 includes an upper sheet member 30 disposed on an upper side and extends from a heel region through a midfoot region to a forefoot region of the shoe 1, a lower sheet member 31 disposed under the upper sheet member 30 and similarly extends from the heel region through the midfoot region to the forefoot region of the shoe 1, and a wavy or generally flat W-shaped corrugated sheet member 32 disposed between the upper sheet member 30 and the lower sheet member 31 and having two protrusions 32*a*, 32*b* that protrude in a downwardly convex shape.

The upper sheet member 30 is shown here in a corrugated shape but it may be flat. In this case, since the upper sheet member 30 solely can secure a flat foot sole contact surface for the shoe wearer, a member such as the midsole $S_1$ can be eliminated. Also, the lower sheet member 31 is shown here in a flat shape in the heel region but it may be gently curved. In this case, a radius of curvature of the lower sheet member 31 is preferably larger than a radius of curvature of each of the protrusions 32*a*, 32*b* of the wavy corrugated sheet member 32, because it is important that the protrusions 32*a*, 32*b* can slide on the lower sheet member 31 in a smooth manner as described hereinafter.

Here, the lower sheet member 31 constitutes an insole of the shoe 1. Generally, "insole" is a member to be attached on a bottom surface of a last when assembling a shoe with the last. A lower portion of an upper of the shoe to be attached on an outer circumferential surface of the last is fixedly attached to the insole. In other words, "insole" is a member provided between a sock liner and a sole of the shoe. In addition, the insole may be integrated with the sole.

As a fixing means for the insole and the upper, in the case of a pulling-over-lasting process, bonding or nailing is used with unwoven fabric, paper, cloth, resin, and the like as materials for the insole. In the case of a slip-lasting process, sewing is used with unwoven fabric, cloth, and the like as materials for the insole. Also, the sole may be integrally formed with the upper at the time of forming the upper with resin as material for the insole. Alternatively, knitted cloth may be used as material for the insole.

Each of the protrusions 32*a*, 32*b* of the wavy corrugated sheet 32 is located at the heel region of the shoe 1. Also, the protrusions 32*a*, 32*b* form voids $V_0$, $V_0'$, respectively with the upper sheet member 30. Each of the downwardly convex portions $\mathbf{32}a_1$, $\mathbf{32}b_1$ of the protrusions 32*a*, 32*b* is in contact with an upper surface 31*a* of the lower sheet member 31 but it is not fixedly attached to the upper surface 31*a*. Each of the downwardly convex portions $\mathbf{32}a_1$, $\mathbf{32}b_1$ of the protrusions 32*a*, 32*b* is adapted to slide longitudinally on the upper surface 31*a* of the lower sheet member 31 when each of the protrusions 32*a*, 32*b* deforms compressively into a flattened shape at the time of a shoe strike onto the ground.

Between the downwardly convex portions $\mathbf{32}a_1$ and $\mathbf{32}b_1$ of the protrusions 32*a*, 32*b* of the wavy corrugated sheet 32 is formed an upwardly convex portion $\mathbf{32}c_1$. A first void $V_1$ is formed between the upwardly convex portion $\mathbf{32}c_1$ and the lower sheet member 31.

The protrusion 32*a* disposed backward is located at a rear end of the heel region. Between an upraised portion of a rear portion of the protrusion 32*a* and the lower sheet member 31 is formed a second void $V_2$. A rear end $\mathbf{32}t_1$ of the upraised portion of the protrusion 32*a* is fixedly attached to a rear end of the upper sheet member 30 directly or indirectly through an elastic block 34.

An upraised portion of a front portion of the protrusion 32*b* disposed forward is located at the midfoot region. Between the upraised portion of the protrusion 32*b* and the lower sheet member 31 is formed a third void $V_3$. A front end $\mathbf{32}t_2$ of the upraised portion is connected to the upper sheet member 30 through the midsole $S_3$ of a soft elastic material. In addition, the front end $32t_2$ of the upraised portion may be directly attached to the upper sheet member 30.

The upwardly convex portion $32c_1$ between the downwardly convex portions $32a_1$ and $32b_1$ is preferably connected to the upper sheet member 30 through an elastic block 33. In this case, the upwardly convex portion $32c_1$ may be directly connected to the upper sheet member 30.

Each of the upper and lower sheet members 30, 31 and the wavy corrugated sheet member 32 is preferably formed of a hard resin plate in order to prevent loss of elasticity due to repetitious deformation to maintain the shape of each of the voids and to secure a smooth slide between the wavy corrugated sheet member 32 and the lower sheet member 31. For example, the upper and lower sheet members 30, 31 and the wavy corrugated sheet member 32 are formed of thermoplastic resin such as thermoplastic polyurethane (TPU), polyamide elastomer (PAE), ABS resin and the like, or thermosetting resin such as epoxy resin, unsaturated polyester resin and the like. Alternatively, fiber-reinforced plastics with carbon fibers, metal fibers or the like may be used. In addition, it is possible that the upper and lower sheet members 30, 31 and the wavy corrugated sheet 32 are formed of rubber, ethylene-vinyl acetate copolymer (EVA) or foamed EVA.

As material for forming the elastic block member 33, for example, rubber is preferable, but other elastic materials such as urethane, ethylene-vinyl acetate copolymer (EVA), or polyamide elastomer (PAE) may be used.

Figure 3:
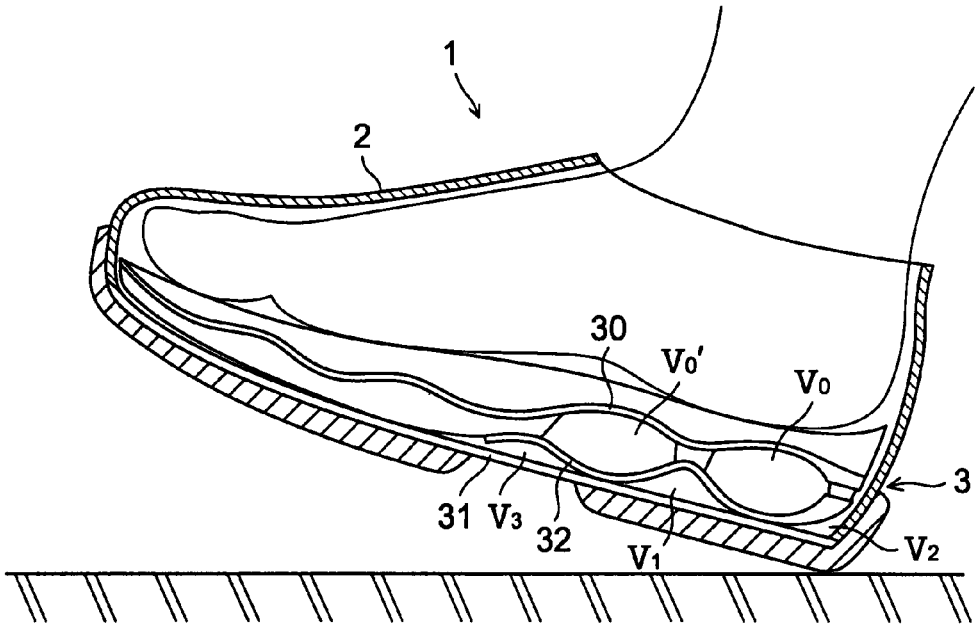
FIG. 3 illustrates the state immediately before a heel strike of the shoe.
Figure 4:
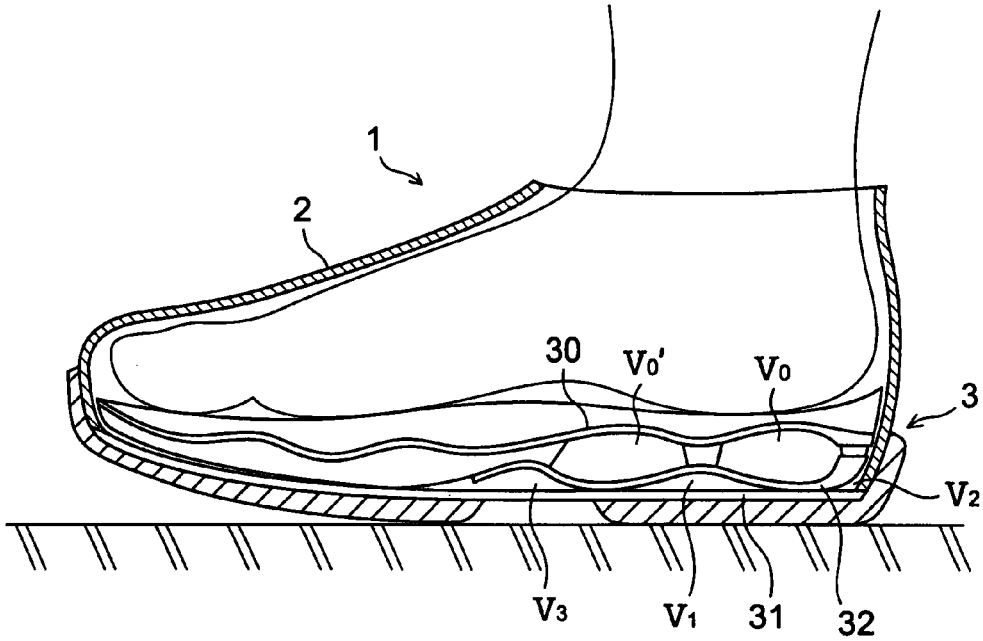
FIG. 4 illustrates the state at the time of a heel strike of the shoe.

When the shoe 1 strikes onto the ground from the heel rear end as shown in FIG. 3, and the heel entire surface comes into contact with the ground as shown in FIG. 4, a compressive load acts onto the upper and lower sheet members 30, 31 of the inner sole structure 3 and the inner sole structure 3 is compressed in the upper and lower direction. Thereby, each of the voids $V_0$, $V_0'$, and $V_1$ deforms into a more flattened shape (see FIGS. 3 and 4).

Figure 5A:
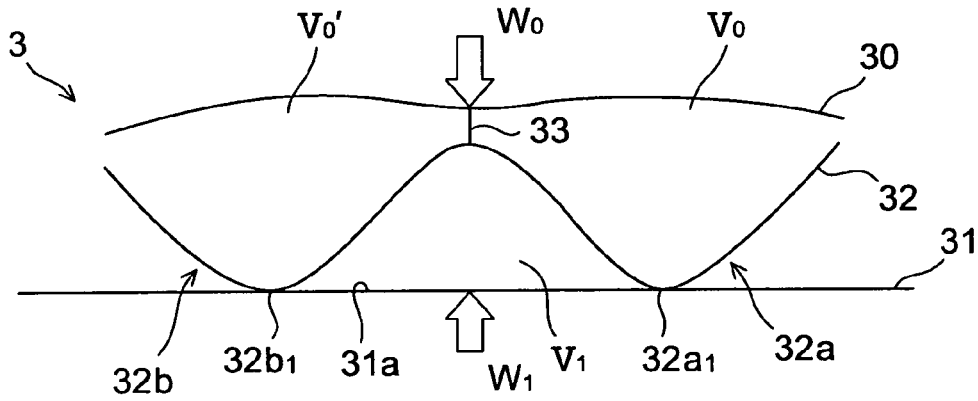
FIG. 5A is a schematic diagram showing the state before a heel strike of the inner sole structure.
Figure 5B:
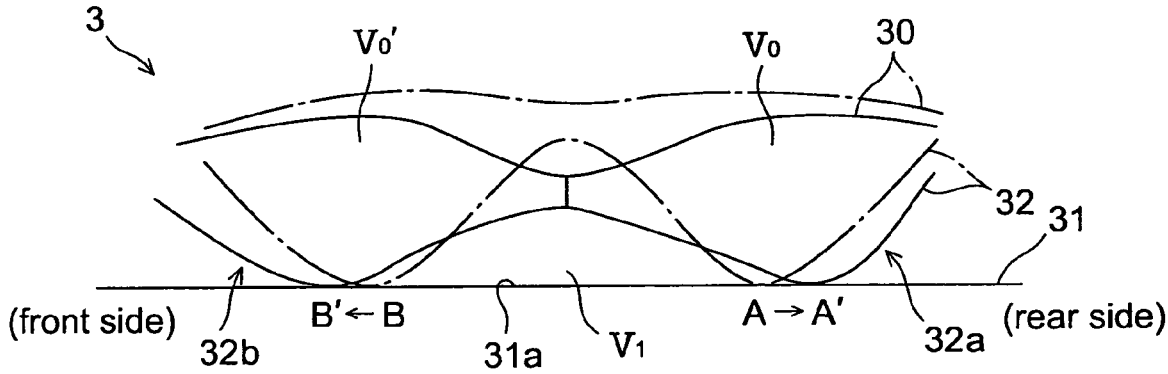
FIG. 5B is a schematic diagram showing the state after a heel strike of the inner sole structure.

Here, we will explain in more detail using FIGS. 5A and 5B. FIG. 5A shows the state before a heel strike, which corresponds to FIG. 3. FIG. 5B shows the state after the heel strike, which correspond to FIG. 4. A dash-and-dot-line of FIG. 5B shows the state of the upper sheet member 30 and the wavy corrugated sheet 32 before the heel strike (and thus, before deformation), and a solid line shows the state after the heel strike (and thus, after deformation).

After the heel strike, the upper sheet member 30 of the inner sole structure 3 receives a downward load $W_0$ from the foot sole of the shoe wearer, and the lower sheet member 31 receives an upward load $W_1$ from the ground. Thereby, the inner sole structure 3 deforms compressively so as to lessen its height in the upper and lower direction. Then, the wavy corrugated sheet 32, which has been in a flat W-shape before deformation, deforms into a more flattened W-shape. As a result, contacts points A and B between the downwardly convex portions $32a_1$, $32b_1$ of the protrusions 32*a*, 32*b* of the wavy corrugated sheet 32 and the upper surface 31*a* of the lower sheet member 31 move in the direction apart from each other.

That is, the contact point A of the downwardly convex portions $32a_1$ of the protrusion 32*a* with the upper surface 31*a* of the lower sheet member 31 moves backward to the contact point A', and the contact point B of the downwardly convex portions $32b_1$ of the protrusion 32*b* with the upper surface 31*a* of the lower sheet member 31 moves forward to the contact point B'.

In such a way, the downwardly convex portions $32a_1$, $32b_1$ of the protrusions 32*a*, 32*b* slide longitudinally on the upper surface 31*a* of the lower sheet member 31 along the length of the shoe. Thereby, each of the protrusions 32*a*, 32*b* of the wavy corrugated sheet 32 deforms compressively in a smooth manner. As a result, a moderate sinking of the upper sheet member 30 is allowed and the cushioning ability improves. After the heel strike onto the ground, as the load moves toward the forefoot region of the shoe the upper and lower sheet members 30, 31 and the wavy corrugated sheet member 32 that have been compressively deformed are going to return their original states. At this juncture, the downwardly convex portions $32a_1$, $32b_1$ of the protrusions 32*a*, 32*b* of the wavy corrugated sheet 32 are transferred toward each other (i.e. from point A' to A and point B' to B in FIG. 5B) sliding on the upper surface 31*a* of the lower sheet member 31. In such a manner, a returning deformation of the protrusions 32*a*, 32*b* of the wavy corrugated sheet 32 is conducted smoothly.

Moreover, in this case, the wavy corrugated sheet member 32 interposed between the upper sheet member 30 and the lower sheet member 31 prevents an excessive sinking of the upper and lower sheet members 30, 31 and improves landing stability, and due to restraint of the amount of deformation of the upper and lower sheet members 30, 31 durability improves. Especially, since the upwardly convex portion $32c_1$ formed between the downwardly convex portions $32a_1$, $32b_1$ of the protrusions 32*a*, 32*b* of the wavy corrugated sheet 32 is connected to the upper sheet member 30 through the elastic block 33, at the time of the heel strike the upper sheet member 30 is supported from below by the upwardly convex portion $32c_1$ of the wavy corrugated sheet member 32. Thereby, an excessive sinking of the upper sheet member 30 can be securely prevented and cushioning ability of the heel region can be adjusted. Also, by forming the voids $V_0$, $V_0'$, and $V_1$ between the wavy corrugated sheet member 32 and the upper and lower sheet members 30, 31, the entire weight can be reduced.

In addition, the inner sole structure 3 of the present invention is similar to the sole structure shown in FIG. 1A of the Japanese Patent No. 4020953, but the sole structure of JP '953 is not provided with a member corresponding to the lower sheet member of the present invention and also in JP '953 an outsole member that contacts the ground is directly attached to a lower surface of a wavy corrugated sheet member. In this case, when each of protrusions of the wavy corrugated sheet deforms compressively, as with the present invention each of the protrusions needs to deform into a flattened shape. However, in this case, the outsole member itself fitted to each of the protrusions requires a grip relative to the ground and thus it is generally formed of non-slip materials and it has a slip-preventive groove on a ground contact surface. Also, a coefficient of friction of the ground that the outsole member comes into contact with is generally great. Consequently, at the time of a heel strike two outsole members do not slide on the ground smoothly.

To the contrary, according to the present invention, each of the protrusions of the wavy corrugated sheet member is in contact with the lower sheet member, which is a sheet-to-sheet contact, and each of the protrusions can thus smoothly slide along the lower sheet member.

Additionally, an adjusting mechanism to adjust a slide between each of the protrusions 32*a*, 32*b* of the wavy corrugated sheet 32 and the lower sheet member 31 may be provided between the protrusions 32*a*, 32*b* and the lower sheet member 31. For example, on a lower surface of each of the protrusions 32*a*, 32*b* of the wavy corrugated sheet 32 and/or the upper surface of the lower sheet member 31, undulation may be formed, a member of a relatively high coefficient of friction such as urethane sheet may be attached, or a member of a coefficient of friction smaller or greater than a coefficient of friction of each of the sheet members may be applied. In the alternative, rubber and the like may be soaked into the lower surface of each of the protrusions 32*a*, 32*b* and/or the upper surface of the lower sheet member 31.

Also, in this case, since there is formed second void $V_2$ between the lower sheet member 31 and the upraised portion of the rear portion of the protrusion 32*a* disposed at the rear end of the heel region, when the shoe strikes onto the ground from the heel end a compressive deformation of the lower sheet member 31 is not hindered by the upraised portion of the rear portion of the protrusion 32*a* and the lower sheet member 31 can compressively deform in a smooth manner toward the second void $V_2$. Thereby, cushioning ability can be enhanced. Also, formation of the second void $V_2$ can further decrease the weight of the structure.

Furthermore, in this case, since there is formed third void $V_3$ between the lower sheet member 31 and the upraised portion of the front portion of the protrusion 32*b* disposed ahead of the void $V_2$, especially at the time of a foot-flat contact (or a sole entire surface contact) with the ground cushioning ability of the midfoot region can be improved. Also, formation of the third void $V_3$ can further decrease the weight of the structure. Moreover, in this case, since the front end $\mathbf{32}t_2$ of the upraised portion is connected to the upper sheet member 30 through the midsole $S_3$ at the midfoot region and supports the upper sheet member 30 from below, sinking of an arch can be prevented at the time of a sole strike.

In the above-mentioned embodiment, an example in which two voids $V_0$, $V_0'$ are formed between the upper sheet member 30 and the wavy corrugated sheet member 32, the present invention is not limited to such an example. Three or more voids may be formed between the upper sheet member 30 and the wavy corrugated sheet member 32.

FIGS. 6 to 9 show an inner sole structure according to another embodiment of the present invention. Here, an example in which three voids $V_0$, $V_0'$ and $V_0''$ are formed between the upper sheet member 30 and the wavy corrugated sheet member 32. In these drawings, like reference numbers indicate identical or functionally similar elements.

Figure 6:
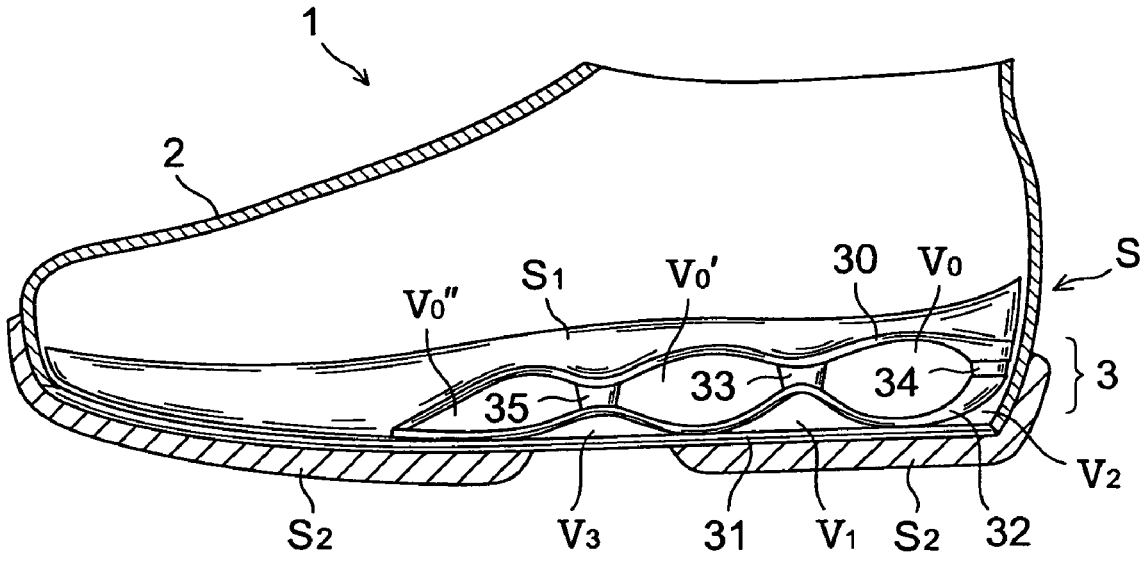
FIG. 6 is a side sectional view of a sports shoe incorporating an inner sole structure according to another embodiment of the present invention.
Figure 7:
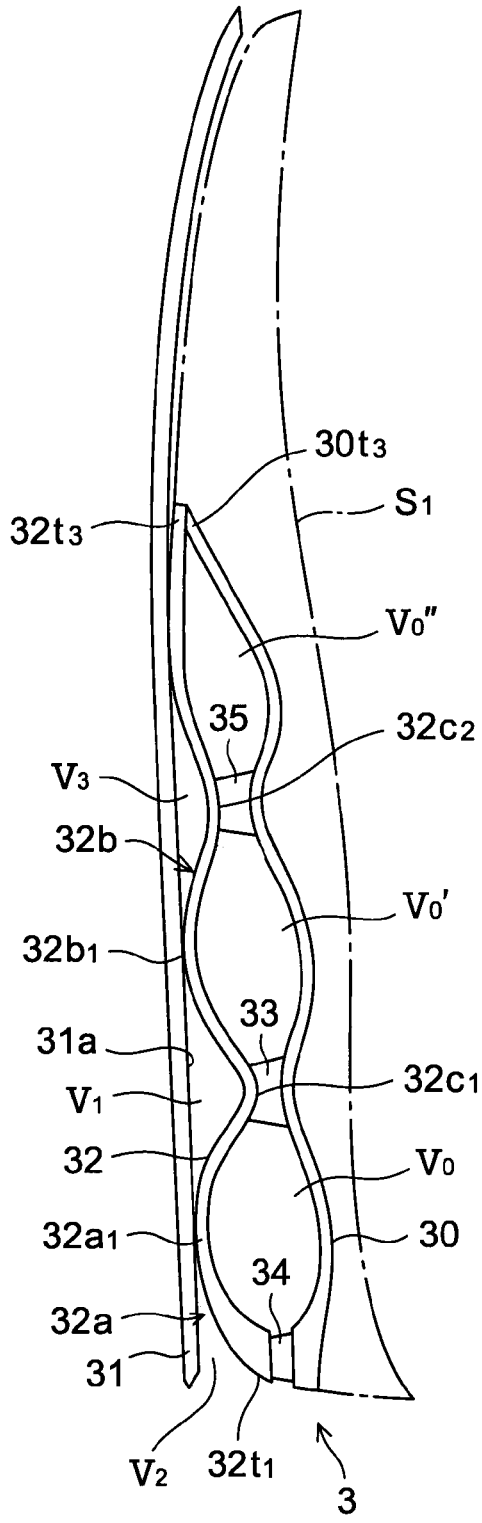
FIG. 7 is an enlarged side view of the inner sole structure of FIG. 6.

As shown in FIGS. 6 and 7, the upper sheet member 30 extends from the heel region through the midfoot region to the rear portion of the forefoot region of the shoe 1. The wavy corrugated sheet member 32 similarly extends from the heel region through the midfoot region to the rear portion of the forefoot region of the shoe 1 and its front end $\mathbf{32}t_3$ is connected to a front end $\mathbf{30}t_3$ of the upper sheet member 30. The wavy corrugated sheet member 32 has an upwardly convex portion $\mathbf{32}c_2$ ahead of the protrusion 32*b*. The upwardly convex portion $\mathbf{32}c_2$ is connected to the upper sheet member 30 through an elastic block member 35. Also, a portion of or the entire wavy corrugated sheet member 32 is in slide-contact with the lower sheet member 31 in front of the elastic block member 35 without being fixedly attached to the lower sheet member 31.

Figure 8:
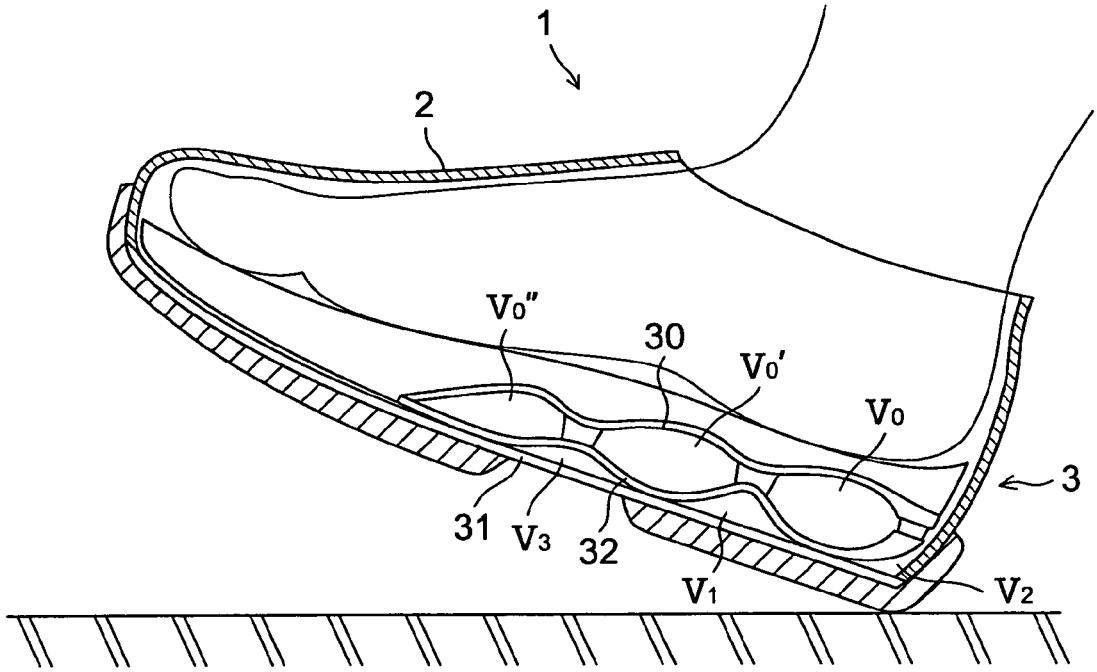
FIG. 8 illustrates the state immediately before a heel strike of the shoe.
Figure 9:
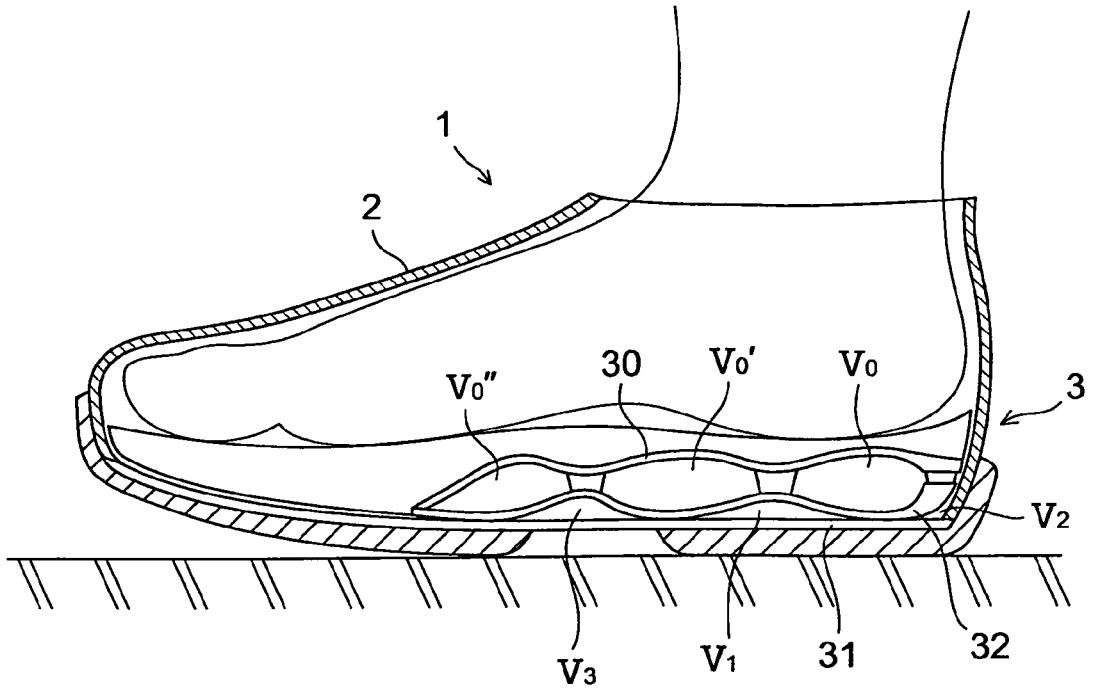
FIG. 9 illustrates the state at the time of a heel strike of the shoe.

In another embodiment as well, when the shoe 1 strikes onto the ground from the heel rear end as shown in FIG. 8, and the heel entire surface comes into contact with the ground as shown in FIG. 9, a compressive load acts onto the upper and lower sheet members 30, 31 of the inner sole structure 3 and the inner sole structure 3 is compressed in the upper and lower direction. Then, each of the voids $V_0$, $V_0'$ and $V_1$ deforms into a flattened shape and contact points between the lower sheet member 31 and each of downwardly convex portion $\mathbf{32}a_1$, $\mathbf{32}b_1$ of the protrusions 32*a*, 32*b* of the wavy corrugated sheet member 32 slide on the upper surface 31*a* of the lower sheet member 31 in the direction away from each other. Thereby, a moderate sinking of the upper sheet member 30 is allowed and cushioning ability improves.

Moreover, in this case, formation of a void $V_0''$ at the rear portion of the forefoot region of the shoe improves cushioning ability at the time of a forefoot strike. Also, since the void $V_0''$ is newly provided between the wavy corrugated sheet member 32 and the upper sheet member 30, the entire weight of the structure can be much further reduced.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. An inner sole structure for a sports shoe comprising:

an upper sheet member disposed on an upper side of at least a heel region of said inner sole structure;

a lower sheet member disposed below said upper sheet member;

a wavy corrugated sheet member that is interposed between said upper sheet member and said lower sheet member, and that has at least two downwardly convex protrusions disposed longitudinally adjacent one another in a longitudinal direction of said inner sole structure, wherein said downwardly convex protrusions form respective voids between said downwardly convex protrusions and said upper sheet member, and wherein said downwardly convex protrusions are not fixedly attached to, but rather are in sliding contact with, an upper surface of said lower sheet member such that said downwardly convex protrusions slide longitudinally in said longitudinal direction along said lower sheet member when said wavy corrugated sheet member is subjected to compressive deformation; and a first cushion of a deformable elastic material arranged extending along at least a portion of a surface of said upper sheet member, wherein a front end portion of said wavy corrugated sheet member in said longitudinal direction is connected to said first cushion, and wherein said first cushion is arranged on top of said upper sheet member and extending along a top surface of said upper sheet member.

2. The inner sole structure according to claim 1, wherein said wavy corrugated sheet member has an upwardly convex protrusion formed between said downwardly convex protrusions, and said upwardly convex protrusion forms another void between said upwardly convex protrusion and said lower sheet member.

3. The inner sole structure according to claim 1, wherein a rearmost protrusion among said downwardly convex protrusions is disposed adjacent and extends to a rear end of said heel region, and directly at said rear end said rearmost protrusion includes an upraised portion that forms a second void between said upraised portion and said lower sheet member directly at said rear end.

4. The inner sole structure according to claim 1, wherein a rearmost protrusion among said downwardly convex protrusions is disposed adjacent and extends to a rear end of said heel region, and at said rear end said rearmost protrusion includes an upraised portion that is connected directly to said upper sheet member.

5. The inner sole structure according to claim 1, further comprising an elastic member, wherein a rearmost protrusion among said downwardly convex protrusions is disposed adjacent and extends to a rear end of said heel region, and at said rear end said rearmost protrusion includes an upraised portion that is connected to said upper sheet member through said elastic member interposed therebetween.

6. The inner sole structure according to claim 1, wherein one of said downwardly convex protrusions includes at a forward end thereof an upraised portion that is disposed at a midfoot region of said inner sole structure, and that forms a third void between said upraised portion and said lower sheet member.

7. The inner sole structure according to claim 6, wherein said upraised portion is connected directly to said upper sheet member.

8. The inner sole structure according to claim 6, further comprising an elastic member, wherein said upraised portion is connected to said upper sheet member through said elastic member interposed therebetween.

9. The inner sole structure according to claim 1, wherein said first cushion is elastically deformable and said front end portion of said wavy corrugated sheet member is connected to said first cushion such that said front end portion can move longitudinally in said longitudinal direction by an elastic deformation of said first cushion when said wavy corrugated sheet member is subjected to compressive deformation.

10. The inner sole structure according to claim 1, wherein said wavy corrugated sheet member has an upwardly convex protrusion formed between said downwardly convex protrusions, and said upwardly convex protrusion is connected directly to said upper sheet member.

11. The inner sole structure according to claim 1, further comprising an elastic member, wherein said wavy corrugated sheet member has an upwardly convex protrusion formed between said downwardly convex protrusions, and said upwardly convex protrusion is connected to said upper sheet member through said elastic member interposed therebetween.

12. The inner sole structure according to claim 1, wherein said wavy corrugated sheet member has, from a side view, a somewhat flattened generally W-shaped configuration having only exactly two said downwardly convex protrusions.

13. The inner sole structure according to claim 1, wherein said lower sheet member constitutes an insole of said shoe, and said insole is fixedly attached to an upper of said shoe by at least one of bonding, nailing, sewing and integral forming.

14. The inner sole structure according to claim 13, wherein said upper sheet member and said wavy corrugated sheet member constitute an insole insert that is removable from said shoe.

15. The inner sole structure according to claim 1, wherein said wavy corrugated sheet member is not fixedly attached to said lower sheet member.

16. A shoe having a heel region, a forefoot region, and a midfoot region between said forefoot region and said heel region, said shoe comprising;

an upper;

an outsole attached at a bottom of said upper; and an inner sole structure that is arranged above said outsole and that comprises:

an upper sheet, a lower sheet below said upper sheet, and a wavy corrugated sheet between said upper sheet and said lower sheet at least at said heel region but not at said forefoot region of said shoe;

wherein:

said wavy corrugated sheet includes either exactly two or exactly three downwardly convex corrugations that are disposed longitudinally adjacent one another in a longitudinal direction with respect to a longitudinal length of said shoe, said downwardly convex corrugations are not fixedly attached to, but rather are in sliding contact with, an upper surface of said lower sheet, such that said downwardly convex corrugations slide longitudinally along said lower sheet when said wavy corrugated sheet is subjected to compressive deformation, said wavy corrugated sheet further includes a respective upwardly convex corrugation disposed longitudinally between a respective adjacent pair of said downwardly convex corrugations, respective voids are formed between said downwardly convex corrugations and said upper sheet, and between said respective upwardly convex corrugation and said lower sheet, said upper sheet has wavy corrugations including upwardly convex corrugations respectively above said downwardly convex corrugations of said wavy corrugated sheet and including a respective downwardly convex corrugation above said respective upwardly convex corrugation of said wavy corrugated sheet, and a front end portion and each said upwardly convex corrugation of said wavy corrugated sheet is respectively attached to said upper sheet directly or through a respective interposed elastic material member.

17. The shoe according to claim 16, wherein said wavy corrugated sheet is not fixedly attached to said lower sheet.

18. The shoe according to claim 16, wherein said lower sheet is fixedly attached to said upper of said shoe by at least one of bonding, nailing, sewing and integral forming, and said lower sheet constitutes an insole of said shoe.

19. The shoe according to claim 16, wherein said upper sheet and said wavy corrugated sheet constitute an insole insert that is separable from said lower sheet and removable from said upper of said shoe.

20. The shoe according to claim 16, wherein said wavy corrugations of said wavy corrugated sheet are provided only at said heel region of said shoe, and are not provided at said forefoot region, and are not provided at said midfoot region of said shoe.

21. The shoe according to claim 16, further comprising said elastic material member that is interposed between and interconnects said upwardly convex corrugation of said wavy corrugated sheet and said upper sheet.

22. The shoe according to claim 16, wherein said inner sole structure further comprises a footbed cushion member of an elastic material disposed on top of said upper sheet, at said heel region and at said midfoot region and at said forefoot region of said shoe.

23. The shoe according to claim 22, wherein said inner sole structure further comprises a lower cushion member disposed under said upper sheet at said forefoot region and extending rearwardly such that a rearward portion of said lower cushion member is disposed between said upper sheet and a forward portion of said wavy corrugated sheet.

24. The shoe according to claim 16, wherein said inner sole structure further comprises an elastic cushion material disposed at least on top of said wavy corrugated sheet, wherein a forward end portion of said wavy corrugated sheet is connected to said upper sheet directly or through said elastic cushion material such that said forward end portion can move longitudinally in said longitudinal direction by an elastic deformation of at least one of said elastic cushion material and said upper sheet when said wavy corrugated sheet is subjected to compressive deformation.

25. The shoe according to claim 16, wherein said lower sheet is flat or said lower sheet is gently and smoothly downwardly convexly curved.

26. A removable insole insert for a shoe, comprising:

a footbed cushion member extending longitudinally in a longitudinal direction along a heel region, a midfoot region and a forefoot region of said removable insole insert;

an upper sheet disposed under and connected to at least a portion of said footbed cushion member at least at said heel region and said midfoot region;

a wavy corrugated sheet disposed under at least a portion of said upper sheet at least at said heel region; and a lower cushion member of a deformable elastic material disposed under and connected to said upper sheet at least at said forefoot region and extending into said midfoot region;

wherein:

said wavy corrugated sheet includes at least two downwardly convex corrugations disposed longitudinally adjacent one another with respect to said longitudinal direction, said wavy corrugated sheet further includes at least three upwardly directed portions respectively longitudinally beside said downwardly convex corrugations, a forward-most one of said upwardly directed portions at a front end portion of said wavy corrugated sheet is connected to said lower cushion member and thereby is connected through said lower cushion member to said upper sheet, and other ones of said upwardly directed portions of said wavy corrugated sheet are respectively connected to said upper sheet directly or through a respective interposed elastic material element, respective hollow voids are formed respectively between said upper sheet and said downwardly convex corrugations of said wavy corrugated sheet, said downwardly convex corrugations of said wavy corrugated sheet are freely exposed facing downwardly at a bottom of said removable insole insert, and said removable insole insert is configured and dimensioned to be removably inserted into an upper of the shoe such that said removable insole insert rests removably on an insole of the shoe, whereby said downwardly convex corrugations of said wavy corrugated sheet are adapted to slide longitudinally along the insole of the shoe when said wavy corrugated sheet is subjected to compressive deformation.

27. The inner sole structure according to claim 1, further comprising a second cushion of a deformable elastic material arranged between said upper sheet member and said lower sheet member.

28. The inner sole structure according to claim 27, wherein said front end portion of said wavy corrugated sheet member is connected to said upper sheet member by said second cushion interposed between said front end portion of said wavy corrugated sheet member and said upper sheet member.

29. The inner sole structure according to claim 1, wherein said front end portion of said wavy corrugated sheet member is additionally attached directly to said upper sheet member.

* * * * *